United States Patent [19]

Fink

[11] Patent Number: 4,697,792

[45] Date of Patent: Oct. 6, 1987

[54] MELTING FURNACE

[76] Inventor: Karl Fink, Bauhofstrasse 8, A-8435 Wagna bei Leibnitz, Austria

[21] Appl. No.: 901,302

[22] Filed: Aug. 27, 1986

[30] Foreign Application Priority Data

Aug. 28, 1985 [AT] Austria ..... 2511/85

[51] Int. Cl.[4] ..... C21B 13/08; C22B 7/00

[52] U.S. Cl. ..... 266/248; 75/61; 266/213

[58] Field of Search ..... 266/248, 213; 75/61

[56] References Cited

U.S. PATENT DOCUMENTS 3,291,472 12/1966 Hoff ..... 266/213

3,360,253 12/1967 Mori ..... 75/61

4,385,748 5/1983 Murakami ..... 266/213

*Primary Examiner*—Peter D. Rosenberg

*Attorney, Agent, or Firm*—Karl F. Ross; Herbert Dubno

[57] ABSTRACT

A melting furnace has a drum rotating in operating position about an approximately horizontally arranged axis of rotation and being provided within the area of the rear end with a burner and with a discharge opening and comprising within the area of the opposite front end an opening for charging and for extracting combustion gas, the latter opening being provided with a pressure head lid being movable between a closed position and an opened position and maintaining in the closed position an annular gap for the escape of the effluent gases. That end of the drum, which has the opening for charging, is conically shaped and extends into an effluent gas chamber which is connected with a stack via an effluent gas pipe.

The drum is swivellably supported within a supporting bed for swivelling movement around an approximately horizontal axis intersecting the axis of rotation and is guided by guide rolls, so that it is possible to give the axis of rotation an inclined position in both directions. In the one swivelled position, the melt is discharged via the discharge opening, and in the other swivelled position, melt residues are discharged via the charging opening.

15 Claims, 2 Drawing Figures

MELTING FURNACE

FIELD OF THE INVENTION

The invention refers to a melting furnace, in particular for utilizing scrap aluminium.

BACKGROUND OF THE INVENTION

When utilizing scrap aluminium, there exists the problem of separating from the aluminium during the melting process the contaminations consisting of foreign metals having a greater specific gravity than aluminium and of other impurities for the purpose of obtaining for further processing an aluminium of maximum possible purity.

For melting such scrap aluminium, there were used up till now hearth furnaces having a melting chamber, the bottom of which is inclined and is heated by burners. The melting chamber is charged with the scrap aluminium which must be covered by a layer of melting salt for preventing oxidation of the aluminium during the melting process effected by means of the burners. On account of the aluminium having a lower melting temperature than its contaminations, the molten aluminium flows downward along the inclined bottom into a storage basin, whereas the contaminations, being still in a solid condition, remain resting on the bottom and must manually be removed from the melting chamber via lateral doors after having finished a heat. The use of such a known melting furnace for melting scrap aluminium suffers from various drawbacks. For example, manual removal of the residues from the melting chamber is a laborsome and time-consuming operation. The periods of disuse of the furnace are thus long.

Furthermore, the burner flames heat in a furnace of this known type only the surface of the scrap aluminium contained within the melting chamber, so that the heat supplied is only poorly utilized and the major portion of this heat is exhausted by the hot effluent gas. Such a hearth furnace thus has a poor efficiency.

There are further known rotary furnaces, in which the drum is rotated around its longitudinal axis and is supported for being swivelled or tilted, respectively, around a swivel axis transversely arranged relative to the longitudinal axis. In a known rotary furnace of this type, charging and discharging of the drum is effected via one and the same opening provided at one front side and having there arranged a swing-out burner, whereas at the opposite front side there is only provided a discharge opening for the effluent gases.

There are also known rotary furnaces which are provided with one opening at each of both front sides, noting that the opening provided on one front side is used for charging the furnace and for accommodating the burner and the opening provided at the other front side is used for discharging the furnace and for removing the effluent gases. There is also known a tiltable rotary furnace, in which the charging opening, via which the effluent gases are withdrawn and which can be closed by a lid, is provided on one front side of the drum and the discharge opening is provided at the other front side of the drum.

All these known rotary furnaces are of only limited utility for melting scrap aluminium contaminated by foreign metals or other accompanying matter because, in particular, the iron contained in the scrap aluminium becomes quite easily alloyed during heating with the aluminium material and thus the purity of the molten aluminium material is adversely affected.

OBJECTS OF THE INVENTION

It is an object of the present invention to provide a melting furnace, which allows melting in a simple manner scrap aluminium contaminated by foreign metals having a greater specific gravity than that of the aluminium or by other accompanying matter, noting that the aluminium is separated from the contaminations during the melting process in an unobjectionable manner, the time spent is low and a high efficiency is obtained. It is a further object of the invention to provide a melting furnace in which the effluent gases are prevented from becoming rapidly exhausted and the heat content of the effluent gases is thus utilized to a substantial extent. Furthermore, a melting furnace is provided which substantially automatically charges the furnace, discharges the melt and removes the residual slag and which does not require the use of expensive melting salt, causing environmental pollution.

BRIEF DESCRIPTION OF THE DRAWING

The invention is diagrammatically illustrated by a drawing in which.

SPECIFIC DESCRIPTION

Figure 1:
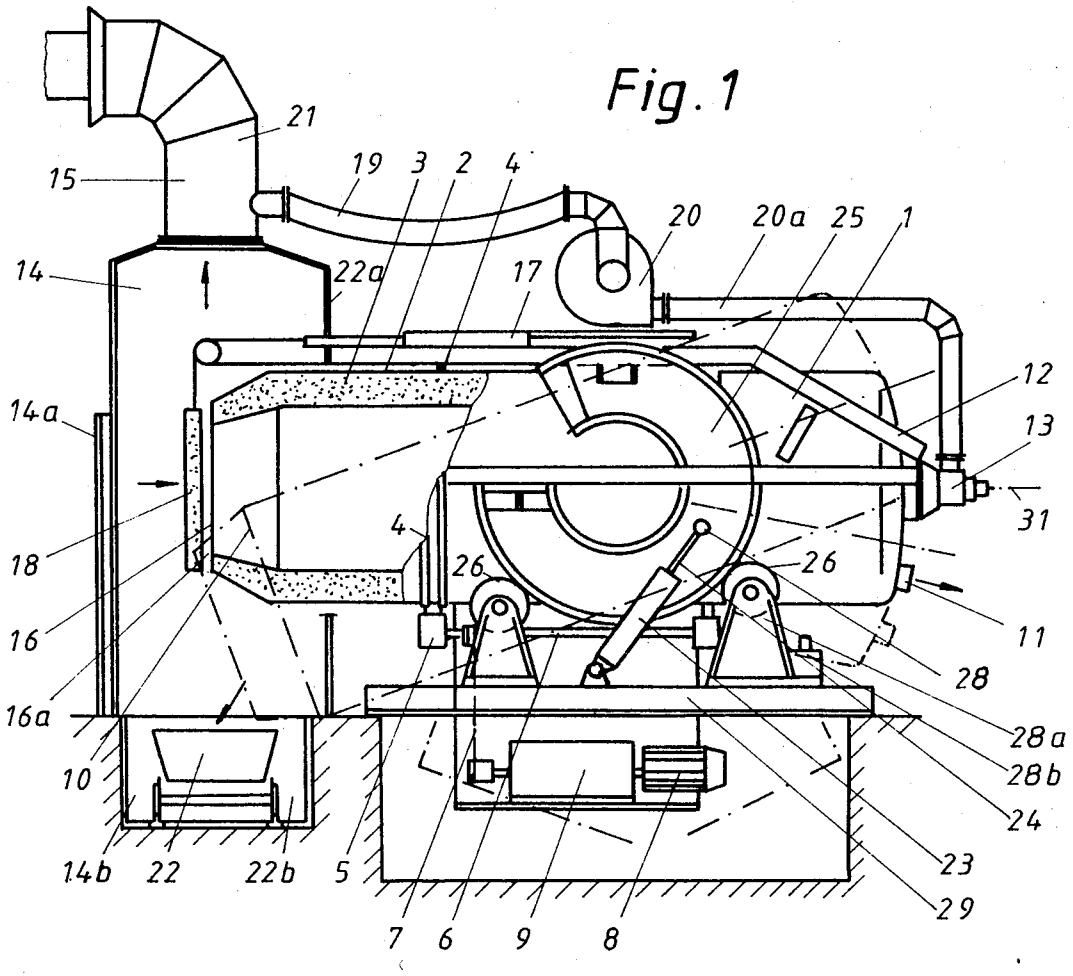
FIG. 1 shows, partially in a side elevation and partially in a longitudinal section, a melting furnace according to the invention.
Figure 2:
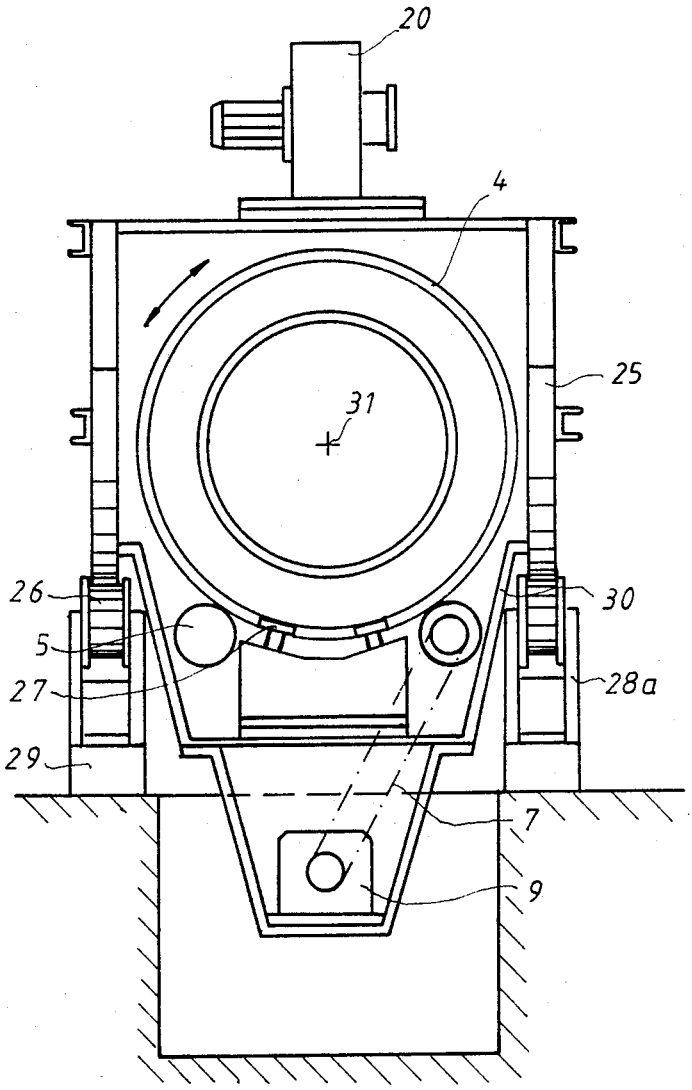
FIG. 2 is an elevational view of the front end of the drum which comprises the opening for introducing the charge and for exhausting the effluent gases, the lid for providing a pressure head and the effluent gas chamber being omitted.

The melting furnace according to the invention has a drum 1 consisting of a steel mantle 2 with a lining 3 of refractory bricks.

The drum 1 has on its circumference two barrel rings 4 being spaced in axial direction and being supported on steel drive rollers 5 which are driven by a shaft 6 connected via a chain drive 7 with the output shaft of a gearing 9 having connected its input shaft with an electromotor 8. The drum 1 is thus rotated around the axis 31 of rotation.

The drive means consisting of the shaft 6, the chain drive 7, the motor 8 and the gearing 9 and the drive rollers 5 are arranged on a supporting bed 30 being connected at both sides of the drum with supporting bodies 25, which are formed of segmental circular discs extending along vertical planes and having their centers located within a horizontal plane including the axis 31 of rotation. The supporting bodies 25 are supported at their circular circumference on supporting rollers 26, which are supported in bearing blocks **28*a*, and which are provided with braking shoes acting on the rolling surfaces of the supporting bodies 25 and being actuated by hydraulic cylinders 28*b*. The bearing blocks 28*a* and the hydraulic cylinders 28*b* are stationarily supported on a base box 29. Furthermore, hydraulic cylinders 23 are swivellably supported on this base box 29 and have their piston rods 24 with their free ends linked to the supporting bodies 25 via pins 28, so that the supporting bodies 25 are moved by the hydraulic cylinders 23 and thereby roll on the supporting rollers 26. Thus, the supporting bed 30 and therewith also the drum 1 rotatably supported within the supporting bed 30 for rotation around the axis 31 of rotation is swivelled. For preventing axial slip of the drum 1, there are installed within the supporting bed 30 four guide rolls 27 cooperating with the drum and rotating about substantially vertical axes. The one inclined end position of the drum 1 is shown in dashed lines in FIG. 1**.

Both inclined end positions of the drum 1 are defined by stops or electrical limit switches, which limit swivelling movement of the drum 1 in both directions.

The supporting bed 30 further carries a blower 20 which is connected with a burner 13 via a conduit 20*a* and which supplies the combustion air to this burner 13. The burner 13 is arranged within the center of the rear end of the drum 1. This rear end, which is designed as the drum bottom, also has the discharge opening 11 for the melt, the position assumed by this discharge opening when discharging the melt being indicated by dash-dotted lines.

The front end, which is located opposite the mentioned rear end, of the drum has an opening 16 for charging the drum and for discharging the effluent gases. A pressure head lid 18 is arranged within the area of this opening 16 such that this lid maintains in its shown closed position an annular gap 16*a*. This pressure head lid 18 can be moved by a lifting means 17, supported on the supporting bed 30 and being preferably electrically actuable, between a closed position shown in the drawing and in an open position clearing the opening 16, noting that a guide means for the pressure head lid 18 is provided on a frame 12 connected with the supporting body 25. The pressure head lid 18, which is in a closed position during the melting process and which maintains only a narrow gap 16*a* for the escape of the effluent gases, is heated by the hot effluent gases and reflects the heat into the interior of the drum. Furthermore, this pressure head lid 18 prevents rapid escape of the hot effluent gases from the drum, so that these gases transfer a substantial portion of their heat content to the charge to be molten. This provides for a very excellent utilization of the heat supplied.

That end 10 of the drum, which has the opening 16, is conically designed and extends into an effluent gas chamber 14 being connected with an effluent gas pipe 15 opening into a stack. This embodiment provides a means for removing the effluent gases in any swivelled position of the drum 1. For preventing any undesired admission of air into the effluent gas chamber 14 and for reliably providing a tight seal in any swivelled position of the drum, the wall, surrounding the drum 1, of the effluent gas chamber 14 is at least partially formed of a heat-resistant apron 22*a*, preferably consisting of asbestos cloth, slidingly contacting the outer circumference of the drum 1, so that this apron may shift when swivelling the drum 1.

A recuperator 21 is arranged within the effluent gas pipe 15 for heating the combustion air prior to being supplied to the blower 20 via the flexible conduit 19.

The effluent gas chamber 14 has at its front side a bipartite effluent gas chamber door 14*a*, which is opened when charging the drum, as is more clearly explained in the following.

Below the opening 16, there is provided within the effluent gas chamber 14 a slag channel 14*b* which can be closed by a tiltable flap 22*b*, so that any undesired supply of air into the effluent gas chamber 14 is avoided. A container car 22 is provided within the slag channel and movable on rails, melt residues being removable by means of this car.

When operating the melting furnace according to the invention, the procedure is as follows:

When starting cold, the arrested drum 1 is preheated by operating the burner 13. Subsequently, the burner is shut down and the drum 1 is swivelled by the hydraulic cylinder 23 into a position in which the axis 31 of rotation is, beginning at the opening 16, slightly inclined in a downward direction. Subsequently, the drum is charged in several stages with scrap aluminium by means of a charging shovel, not shown, the pressure head lid 18 and the effluent gas chamber door 14*a* assuming opened positions. On account of the inclined position of the rotating drum 1, this scrap aluminium slides downwardly from the opening 16.

Subsequently, the opening 16 is closed by the pressure head lid 18, thereby keeping free the annular gap 16*a* for the escape of the effluent gases into the effluent gas chamber 14. Also the effluent gas chamber door 14*a* is closed. The drum 1 is then swivelled into a position in which its axis 31 of rotation extends approximately in a horizontal direction. After having started the operation of the burner 13 and of the blower 20 for the supply of combustion air, the melting process takes place in the rotating drum 1. For the purpose of reducing scaling loss, additives known per se can be added to the drum content.

The melting process can be observed through peep holes within the pressure head lid 18 and within the effluent gas chamber door 14*a*, so that the moment for tapping can be determined.

For discharging the molten, liquid aluminium, the discharge opening 11 is, by stopping the rotating drum 1 at a suitable moment, in a position in which the discharge opening is arranged below the level of the molten pool. Subsequently, the drum is, like during the charging stage, tilted by means of the hydraulic cylinders 23 into a position, in which the discharge opening assumes the position indicated by the dash-dotted lines, and the aluminium is discharged via the discharge opening 11. In this stage, operation of the burner 13 is stopped.

After the tapping operation, the discharge opening 11 is closed, the pressure head lid 18 is brought into an opened position and the drum 1 is tilted in an opposite direction by means of the hydraulic cylinders 23, so that the opening 16 now faces downwardly. Simultaneously, the drum is stepwisely rotated. Melt residues such as iron residues, waste metals and salt residues are thereby discharged from the drum into the container car 22 by means of which they may be transported away. On account of the conical design of the drum end, complete removal of the slag and of the other residues out of the drum 1 can reliably be effected even with an opening 16 of small diameter. Subsequently, the procedure just described is repeated, i.e. the drum 1 is again charged with new scrap aluminium.

All movements and other control operations, for example the starting operation of the burner 13 and of the blower 20, opening and closing of the pressure head lid 18 and of the effluent gas chamber door 14*a*, rotational movement of the drum 1 by starting the motor 8, swivelling movement of the drum 1 by the hydraulic cylinders 23 and so on can be controlled partially according to a preselected program in an automatic manner or partially manually, for example via a suspension switch means.

Conveniently, the burner 13 can be swivellably arranged, which is, however, not shown.

What is claimed is:

1. A melting furnace having an elongated drum for receiving material to be melted and being lined with a refractory material, said furnace comprising means for rotating said drum around an axis of rotation extending in a longitudinal direction of the drum, means for performing a swivelling movement of said drum about a swivelling axis extending substantially horizontally and transverse to said axis of rotation whereby said drum can be inclined to either side of said swivelling axis from a substantially horizontal position of said drum on said swivelling axis, said furnace further comprising a burner provided at a rear end of said drum for heating the interior thereof, a discharge opening for the melt also being provided in said rear end of said drum having said burner, an opening for charging said drum and for discharging combustion gases therefrom being provided at a front end of said drum, said opening being provided with a pressure head lid, and means for moving said pressure head lid between a position giving free access to said opening and a closed position in which between an edge of said opening and said pressure head lid there is formed an annular gap for the escape of said combustion gases.

2. The melting furnace according to claim 1, wherein said drum is rotatably supported with its axis of rotation within a supporting bed provided with segmental circular supporting bodies being supported on stationary supporting rollers, and means for rotating said supporting bodies on said supporting rollers for effecting swivelling movement of said drum.

3. The melting furnace according to claim 2, wherein the means for rotating said supporting bodies are formed by piston-cylinder-arrangements being stationarily supported and acting on said supporting bodies.

4. The melting furnace according to claim 2, wherein on said supporting bed there are provided guiding means and said moving means for coacting with said pressure head lid.

5. The melting furnace according to claim 4, wherein said moving means for said pressure head lid comprises electrical actuating means.

6. The melting furnace according to claim 1, wherein the means for performing the swivelling movement comprises stops for limiting said movement.

7. The melting furnace according to claim 1, wherein the means for performing the swivelling movement comprises electrical limit switches limiting said movement.

8. The melting furnace according to claim 1, wherein braking means are provided for controlling the swivelling movement of said drum.

9. The melting furnace according to claim 8, wherein the braking means are formed by piston-cylinder-arrangements acting on said supporting bodies.

10. The melting furnace according to claim 1, wherein said front end of said drum, which has said opening for charging said drum and for discharging said combustion gases, is conically formed.

11. The melting furnace according to claim 1, wherein said front end of said drum, which has said opening for charging said drum and for discharging said combustion gases, extends into an effluent gas chamber which is connected with a stack.

12. The melting furnace according to claim 11, further comprising a wall surrounding said effluent gas chamber and being at least partially formed by a heat resistant apron engaging the outer circumference of said chamber.

13. The melting furnace according to claim 12, wherein said apron consists of an asbestos cloth.

14. The melting furnace according to claim 11, wherein a lower portion of said effluent gas chamber is designed as a slag channel, which can be closed by a closure element.

15. The melting furnace according to claim 14, wherein a movable container for receiving the melt residues is arranged within said slag channel.

* * * * *